US010961756B2

(12) United States Patent
Cano et al.

(10) Patent No.: US 10,961,756 B2
(45) Date of Patent: Mar. 30, 2021

(54) SHOWER DOOR SYSTEM HAVING ANTI-TORQUE BACK PLATE DEVICE

(71) Applicant: American Glasscrafters, Inc., West Caldwell, NJ (US)

(72) Inventors: Joseph F. Cano, Ridgewood, NJ (US); Michael B. Balagyozyan, Wayne, NJ (US)

(73) Assignee: American Glasscrafters, Inc., West Caldwell, NJ (US)

( * ) Notice: Subject to any disclaimer, the term of this patent is extended or adjusted under 35 U.S.C. 154(b) by 0 days.

(21) Appl. No.: 16/747,412

(22) Filed: Jan. 20, 2020

(65) Prior Publication Data

US 2020/0149332 A1 May 14, 2020

Related U.S. Application Data

(63) Continuation of application No. 15/447,562, filed on Mar. 2, 2017, now abandoned.

(60) Provisional application No. 62/302,322, filed on Mar. 2, 2016.

(51) Int. Cl.
*E05D 15/06* (2006.01)
*A47K 3/34* (2006.01)

(52) U.S. Cl.
CPC ..... *E05D 15/0665* (2013.01); *A47K 3/34* (2013.01); *E05Y 2201/614* (2013.01); *E05Y 2900/114* (2013.01)

(58) Field of Classification Search
CPC . E05D 15/0665; A47K 3/34; E05Y 2201/614; E05Y 2900/114
See application file for complete search history.

(56) References Cited

U.S. PATENT DOCUMENTS

| | | | |
|---|---|---|---|
| 890,950 | A | 6/1908 | Washburn |
| 2,197,385 | A | 4/1940 | Ricken |
| 2,940,113 | A | 6/1960 | Riser |
| 4,769,949 | A | 9/1988 | Glendowne |
| 4,785,485 | A | 11/1988 | Etesam |
| 5,123,128 | A | 6/1992 | Hines |
| 5,598,666 | A | 2/1997 | Kurth |
| 6,381,904 | B1 | 5/2002 | Tedsucci |
| 7,346,939 | B2 | 3/2008 | Perry |
| 8,375,638 | B2 | 2/2013 | Martin et al. |
| 8,915,019 | B2 | 12/2014 | Schachter |
| 9,127,491 | B2 | 9/2015 | Bouthillier |
| 9,364,121 | B2 | 6/2016 | Sprague |

(Continued)

FOREIGN PATENT DOCUMENTS

EP 3078795 10/2016

OTHER PUBLICATIONS

Fleurco Gemini Bypass Enclosure Plus, date of publication: Aug. 22, 2016.
Fleurco Installation manual, date of publication: Nov. 2016.

*Primary Examiner* — Gregory J Strimbu
(74) *Attorney, Agent, or Firm* — Richard Malagiere, Esq.

(57) ABSTRACT

An anti-lift tab of a roller assembly that rides along a fixed rail in use. The anti-lift tab protrudes from the bottom of a face plate having keys molded onto the back face of the face plate which interface with keyways of a castellated nut and shaft component having internal screw threads. A threaded rod is inserted through a bearing seated in the roller assembly. The rod is screwed into the castellated nut and shaft component. A screw attaches the face plate to the castellated nut shaft component and to the roller assembly.

4 Claims, 4 Drawing Sheets

(56) References Cited

U.S. PATENT DOCUMENTS

| | | | |
|---|---|---|---|
| 2009/0145039 | A1 | 6/2009 | Shehoski |
| 2011/0179718 | A1 | 7/2011 | Martin et al. |
| 2016/0206157 | A1 | 7/2016 | Ball et al. |

SHOWER DOOR SYSTEM HAVING ANTI-TORQUE BACK PLATE DEVICE

PRIORITY

This application claims priority to nonprovisional application Ser. No. 15/447,562 filed on Mar. 2, 2017 which claims priority to provisional application 62/302322 filed on Mar. 2, 2016.

BACKGROUND OF INVENTION

The present invention is directed to an improved roller assembly for a rolling door system—specifically for a glass shower door enclosure system. The improved roller assembly features a circular face plate with an anti-lift tab locked into place with keys on the inner face of the circular face plate which mate with keyways in a castellated nut and shaft component. The anti-lift tab protrudes from the bottom of the circular face plate into a channel located below the fixed rail on which the roller assembly rides. The improved roller assembly comes into contact with roller assembly stops at both ends of the fixed rail on which the roller assembly rides.

The prior art discloses anti lift tabs without the anti-torque locking mechanism taught by the present invention. As such, the prior art anti-lift tabs are free to index around the central bolt holding the anti lift tab in place on the roller assembly. The result of this indexing is that the anti-lift tab eventually rubs against the channel in which it rides or adjusts out of position in a way that effects its usefulness as an anti-lift tab.

Additionally, the prior art discloses various mechanical barriers either molded into the parts which make up the roller assembly or added as separate mechanical items to prevent a door suspended from a roller assembly from lifting off of the rails on which it rides. U.S. Pat. Nos. 890,950; 2,197,385; 2,940,113; 4,769,949; 6,381,904; 7,346,939; US 2009/0145039; US 2016/0206157 and EP 3 078 795. U.S. Pat. No. 8,375,638 discloses a decelerator attachment mechanical item which mounts to the top portion of the inner race which acts as a clasp and a bumper to catch the roller assembly when it gets to the end of the race. U.S. Pat. No. 8,915,019 teaches a receiver lock mechanism attached to the outside of a cylindrical race on which the wheel assembly rides. Connected to the outside of the wheel assembly is a device which is fashioned to be received into the lock mechanism attached to the outside of the cylindrical race.

BRIEF SUMMARY OF INVENTION

The objection of the present invention is to disclose a roller assembly for a sliding door with an anti-lift tab that fits into a channel and does not rotate relative to the roller as it translates back and forth along a fixed rail. Further, the object of the invention is to disclose a sliding door assembly employing the anti-lift tab roller assembly in a system including another roller assembly and stops positioned in channels in the fixed race. The anti-lift tab assembly includes a face plate with keys which mate into a castellated nut with keyways which prohibit the anti-lift tab from rotating relative to the roller as it moves along the fixed rail.

DRAWINGS

DETAILED DESCRIPTION OF INVENTION

Figure 1:
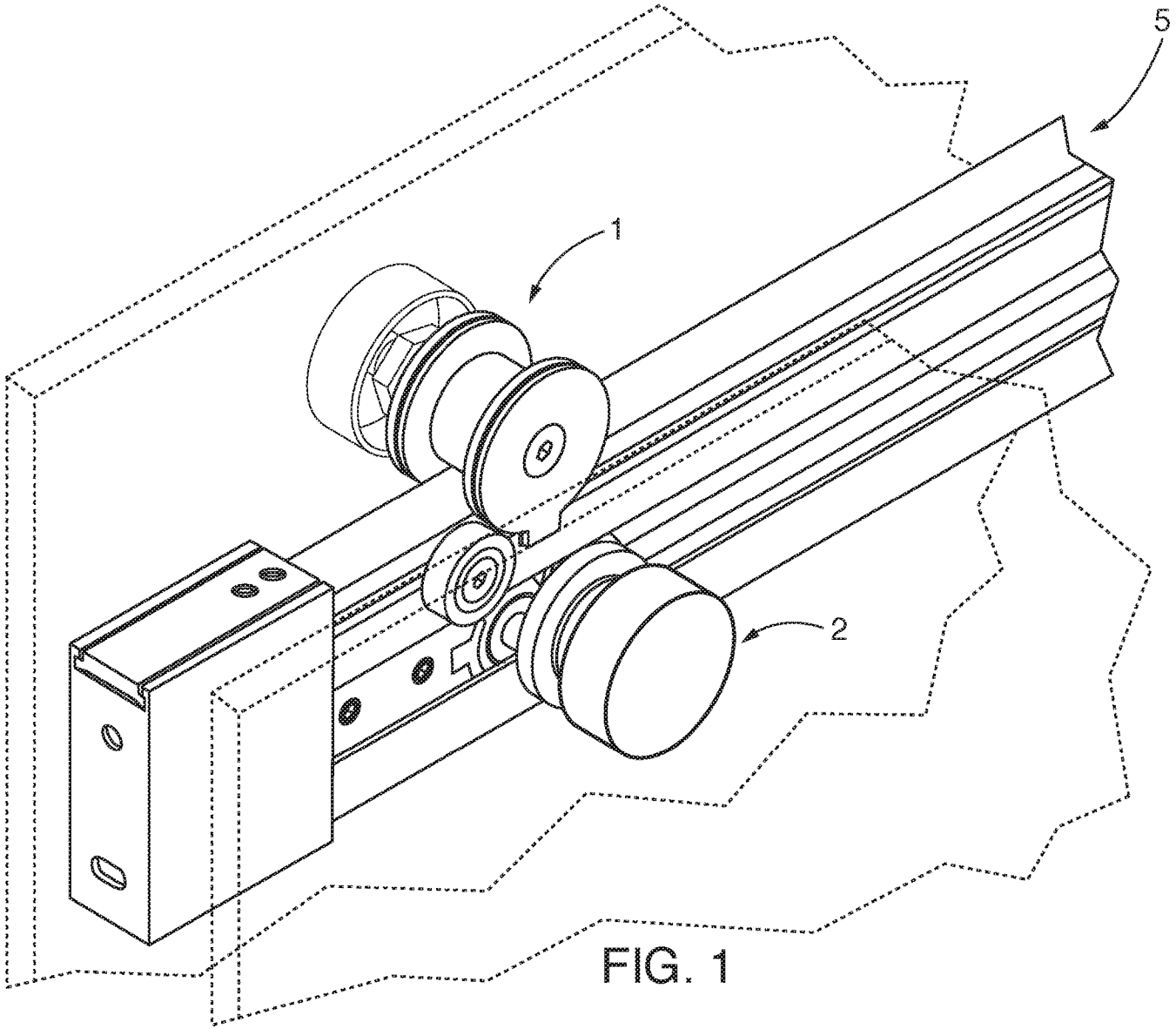
FIG. 1 is an isometric view of the present invention.

The present invention will now be described in terms of the presently preferred embodiment thereof as illustrated in the drawings. Those of ordinary skill in the art will recognize that many obvious modifications may be made thereto without departing from the spirit or scope of the present invention.

Figure 4:
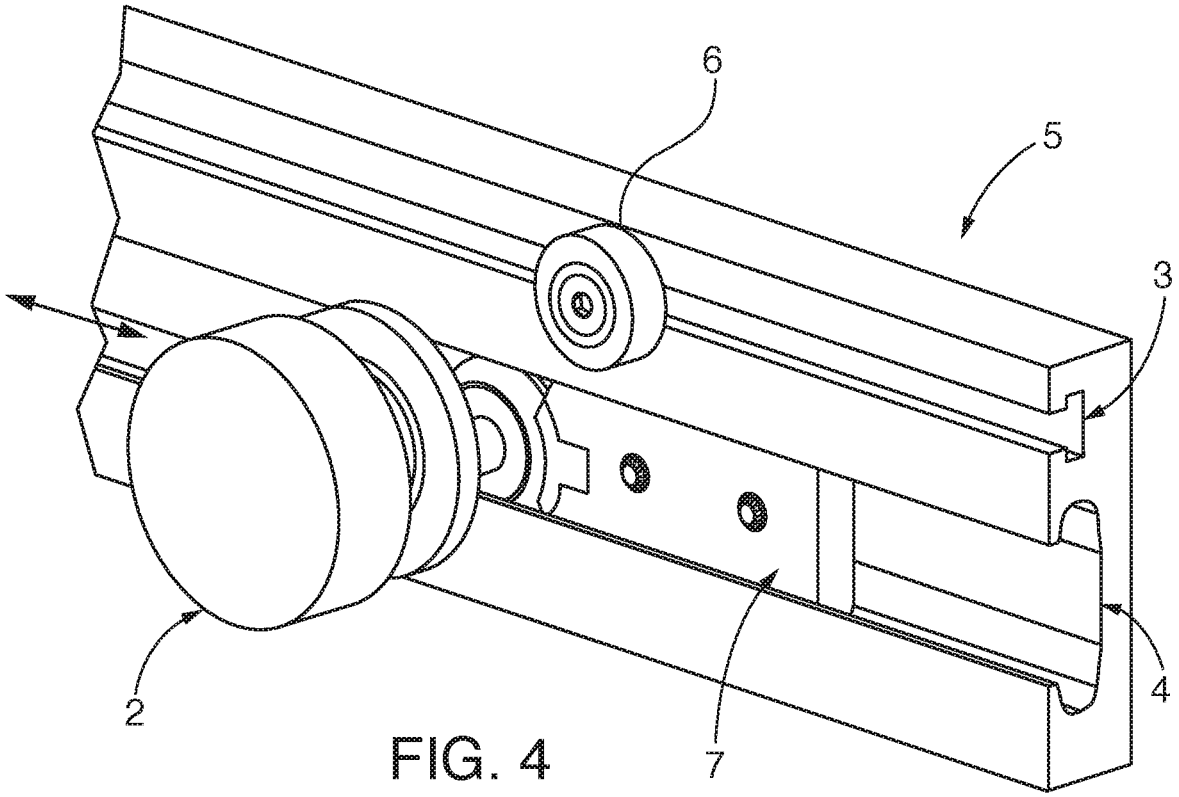
FIG. 4 is a side view of the bottom roller assembly and stop.
Figure 5:
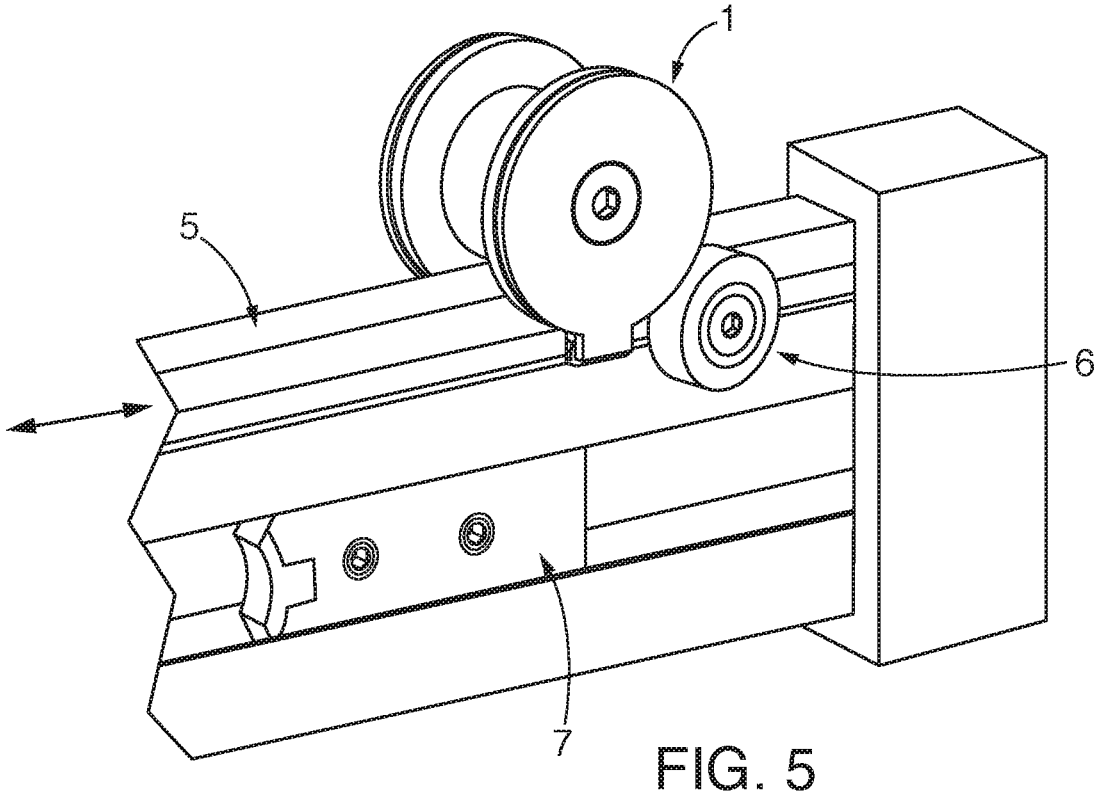
FIG. 5 is a side view of the top roller assembly and stop.

FIG. 1 shows two roller assemblies. One roller assembly 1 riding on a fixed top rail of a shower door enclosure beam 5 with a first channel 3 directly below the fixed top rail where the anti-lift tab attached to the roller assembly rides. FIG. 1 and FIG. 4. The second roller assembly 2 rides inside a second channel 4 below the first channel. FIG. 1 and FIG. 4. Each roller assembly operates as a pair with each located at the ends of the shower door enclosure beam 5 supporting a panel of glass. FIG. 1. Also, roller assembly stops 6 and 7 are fixed inside channels at each end of the shower door enclosure beam. FIG. 4 and FIG. 5.

Figure 3:
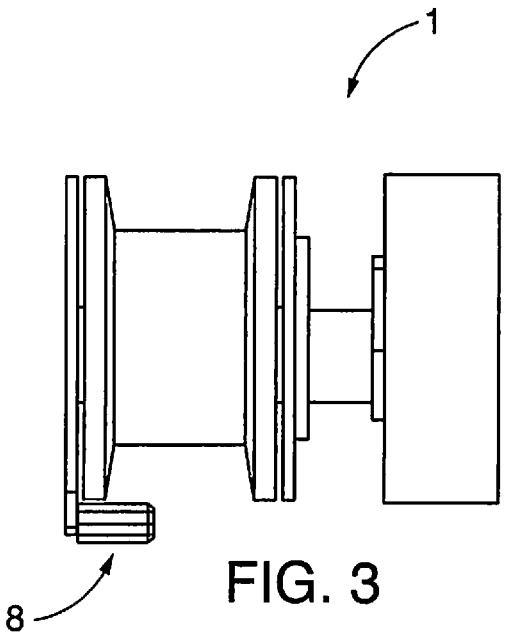
FIG. 3 is a side view of the bearing assembly of the present invention.
Figure 3A:
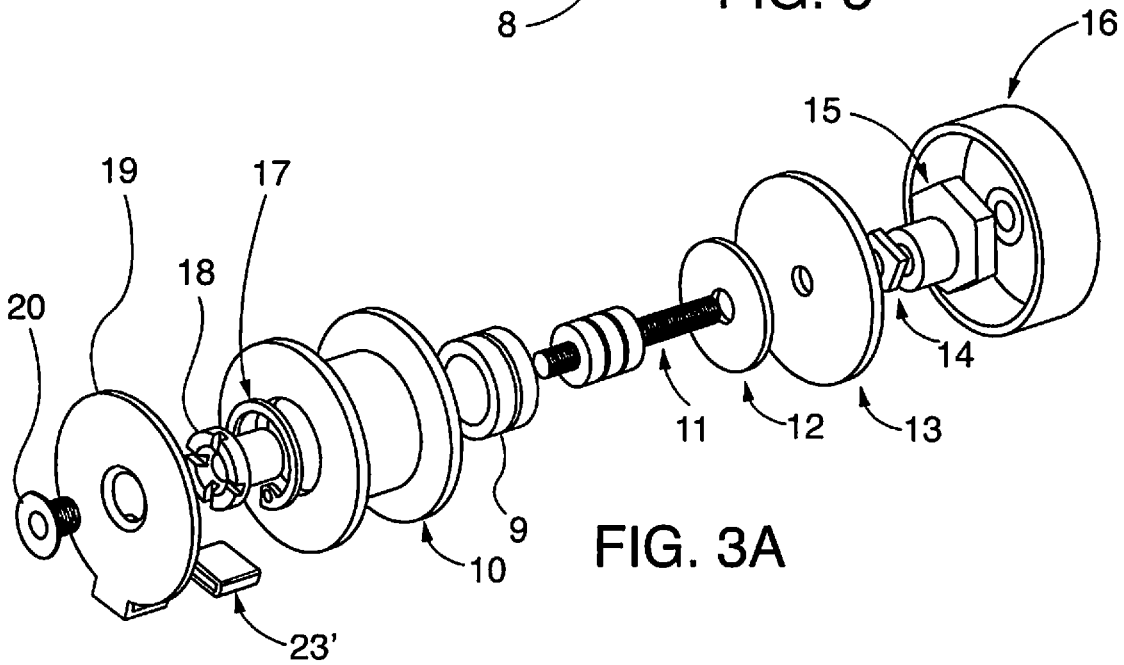
FIG. 3A is an exploded assembly drawing of the present invention.

The roller assembly riding on the fixed top rail 5 is comprised of several components. FIG. 3 is a side view of the roller riding along the top rail displaying the anti-lift tab 8. The roller assembly's central component is a bearing 9 seated into the inner diameter of a roller component 10. Through the inner diameter of that seated bearing is inserted a threaded shaft 11. On one side of the roller component 10 situated toward the inside of the shower enclosure when assembled are the following components fitted onto a threaded shaft going through the bearing inner diameter: a shim 12, a mid-plate 13 , a nut 14, a cam nut 15 and a cover cap 16. A hole in the corner of a glass shower door is placed between the shim 12 and the mid plate 13 and the nut 14 is torqued down to secure the glass door onto the roller assembly 1. FIG. 3A. Of course, a companion hole in the opposite corner of the glass shower door is similarly arranged. FIG. 1.

Figure 2:
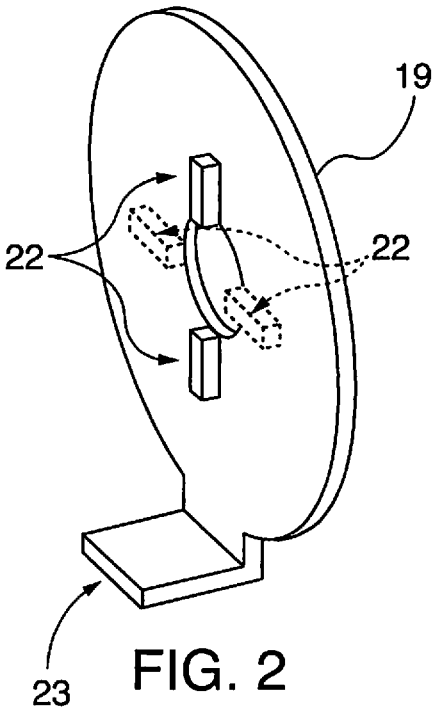
FIG. 2 is an isometric view of a face plate with keys and anti-lift tab.

On the other side of the roller assembly 1 situated toward the room in which the shower enclosure is located when assembled are the following components fitted onto the other side of the threaded shaft 11 going through the bearing 9 inner diameter: a snap ring 17 to hold the bearing into the inner diameter of the roller, a castellated nut and shaft component 18 with key way slots, a face plate 19 with keys 22 molded into its back face and an anti-lift hook 23 protruding out of the bottom of the face plate with a plastic or rubber cover 23' and a face plate screw 20 inserted through the center hole of the face plate 19 and into the threaded internal diameter of the castellated nut and shaft component 18. FIG. 2 and FIG. 3A. Of course, a companion hole in the opposite corner of the glass shower door is similarly arranged. FIG. 1.

The castellated nut and shaft component 18 has internal threads. The castellated nut and shaft component 18 is placed with its shaft side toward the front face of the bearing 9 and its castellated nut side facing outward exposing the keyways on this nut. FIG. 3A. The face plate with molded keys 19 (FIG. 2) in its back face is then placed onto the castellated nut 18 such that keys on the back face of the face plate 19 engage with the keyways in the castellated nut head. FIG. 3A. A screw 20 is inserted through the center hole of the face plate 19 and into the threaded inside diameter of the castellated nut head 18. FIG. 3A. In this way, the roller 10 and pressed in bearing 9 can rotate as the glass door is moved from left to right along the fixed rail 5 while the face plate 19 with the anti-lift hook 23 protruding out of the bottom and inserted into the first channel 3 remains fixed. FIG. 1, FIG. 2 and FIG. 3A.

The sliding door assembly is comprised of two doors, each riding on two pair of roller assemblies 1 and 2 located on each end of the respective door. FIG. 1. One sliding door assembly is attached to two first roller assemblies 1 fixed on each end of the sliding door that rides on the top of a fixed rail 5 above an upper channel 3 where the anti-lift tab 23 fits. FIG. 1, FIG. 2 and FIG. 4. The second door assembly is attached to two second roller assemblies 2 attached to each end of the sliding door that rides in a lower channel 4 in the fixed rail 5. FIG. 1 and FIG. 4. Door stops 6 and 7 are attached inside the upper channel 3 at each end of the fixed rail 5. FIG. 4. and FIG. 5. Similarly, door stops 7 are attached inside the lower channel 4 at each end of the fixed rail 5. FIG. 4 and FIG. 5.

Figure 7:
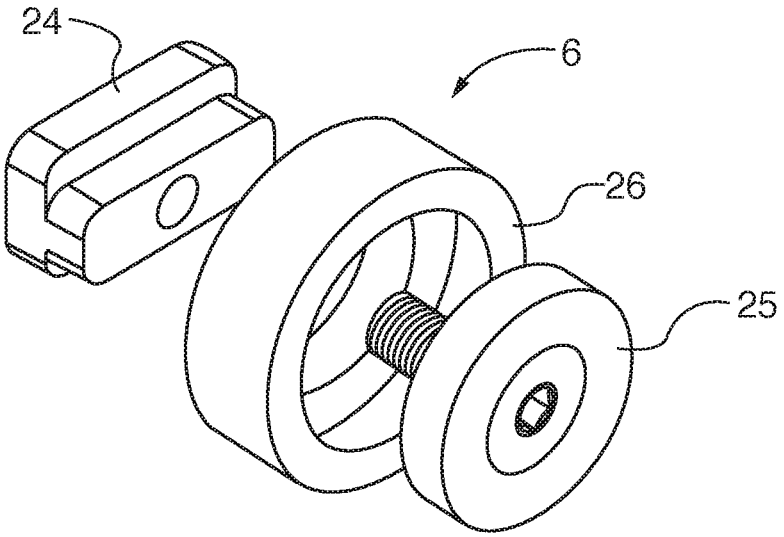
FIG. 7 is an exploded assembly view of the top roller assembly stop.

In operation, the sliding door that rides on the roller assemblies I on the top of the fixed rail 5 is outfitted with an anti-lift tab 23 on the outside face of the roller assemblies 1 on each door end. Fig I and FIG. 2. These tabs 23 are locked into place so that they do not move relative to the roller 10 as the roller assembly 1 translates back and forth on top of the fixed rail. Fig I, FIG. 3A and FIG. 5. These tabs 23 fit into an upper channel 3 located below the top of the fixed rail 5 and work to prevent the door from lifting up and off of the top of the fixed rail 5. FIG. 2, FIG. 4 and FIG. 5. At each end of the fixed rail 5, the tab 23 comes into contact with a stop 6 fixed into the upper channel 3 below the top of the fixed rail 5 which stops the door from rolling off of the fixed rail 5. FIG. 2, FIG. 4 and FIG. 5. The stop 6 in the upper channel 3 is fixed into that channel by a nut plate 24 into which a screw 25 is inserted through the bumper 26 made of a plastic or rubber material. FIG. 7.

Figure 6:
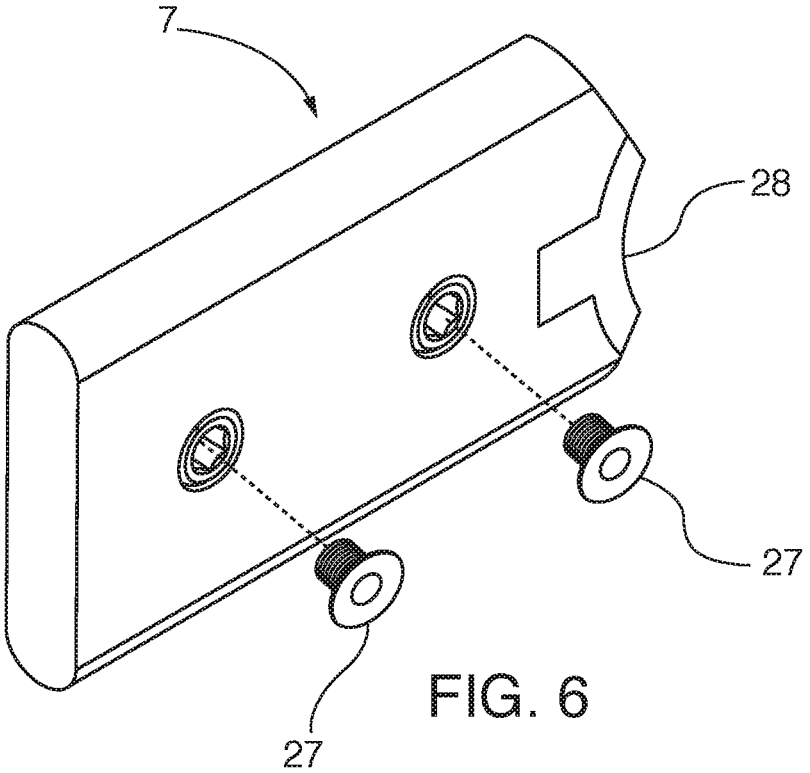
FIG. 6 is a side view of the bottom roller assembly stop.

The shower door that rides on the roller assemblies 2 in the lower channel 4 in the fixed rail 5 are captured inside the channel in the rail. FIG. 4. At each end of the fixed rail 5, the roller comes into contact with a stop 7 fixed into the lower channel 4 in the fixed rail 5 which operates to stop the door. FIG. 4. The stop 7 in the lower channel 4 is fixed into that channel by two flat bottom screws 27 inserted through the stop 7 that set against the back of the lower channel 4. FIG. 6. The stop has a plastic or rubber stop insert 28. FIG. 6.

Those of ordinary skill in the art will recognize that the embodiments just described merely illustrate the principles of the present invention. Many obvious modifications may be made thereto without departing from the spirit or scope of the invention as set forth in the appended claims.

The invention claimed is:

1. An anti-torque and anti-lift roller device that rides on a fixed rail comprising:

a roller with an outer roller diameter and an inner roller diameter wherein a bearing is fixed in the roller and said bearing having a front bearing face, a rear bearing face and an inner bearing opening;

a castellated nut and shaft component having an inner tapped through hole, a shaft face and a castellated nut face, the castellated nut face having keyway slots;

a circular plate having a front face, a rear face, a through hole, an outer circumference and an anti-lift hook, said rear face of the circular plate having protruding keys and said anti-lift hook having a first leg and a second leg, the first leg projecting radially outwardly from the outer circumference of the circular plate in a plane of the circular plate and the second leg of the anti-lift hook projecting from the first leg perpendicular to the plane of the circular plate;

the fixed rail having an upper surface on which the roller rides and a slot disposed below the upper surface into which the second leg of the anti-lift hook is slidably disposed;

a threaded shaft having a first end and a second end, said threaded shaft inserted into and through the inner bearing opening of the bearing fixed in the roller, a nut screwed onto the first end of the threaded shaft and set against a mid-plate, the castellated nut and shaft component screwed onto the second end of the threaded shaft and the shaft face of the castellated nut and shaft component set against the front bearing face of the bearing fixed in the roller;

the rear face of the circular plate secured against the castellated nut face of the castellated nut and shaft component by a screw inserted through the through hole of the circular plate and into the inner tapped through hole of the castellated nut and shaft component such that the protruding keys on the rear face of the circular plate engage with the keyway slots in the castellated nut face prohibiting the circular plate from rotating relative to the castellated nut and shaft component roller the roller is prevented from lifting up and off of the fixed rail by the second leg of the anti-lift hook of the circular plate sliding in the slot of the fixed rail as the device moves on the fixed rail.

2. The anti-torque and anti-lift roller device of claim 1, wherein the castellated nut face keyway slots and the protruding keys on the rear face of the circular face plate are vertically oriented.

3. The anti-torque and anti-lift roller device of claim 1, wherein the castellated nut face keyway slots and the protruding keys on the rear face of the circular face plate are horizontally oriented.

4. The anti-torque and anti-lift roller device of claim 1, wherein the castellated nut face keyway slots and the protruding keys on the rear face of the circular face plate are both vertically and horizontally oriented.

* * * * *